United States Patent [19]

Mack

[11] Patent Number: 4,779,288

[45] Date of Patent: Oct. 25, 1988

[54] REUSABLE BIB HAVING MATERIAL-RECEIVING POCKET

[75] Inventor: Robert J. Mack, Aberdeen, N.J.

[73] Assignee: Colgate-Palmolive Company, New York, N.Y.

[21] Appl. No.: 113,086

[22] Filed: Oct. 26, 1987

[51] Int. Cl.[4] ..... A41B 13/10

[52] U.S. Cl. ..... 2/49 R; 2/51

[58] Field of Search ..... 2/49 R, 48, 50, 51, 2/46, 49 A

[56] References Cited

U.S. PATENT DOCUMENTS

| | | | |
|---|---|---|---|
| 4,601,065 | 7/1986 | Sigl et al. | 2/49 R |
| 4,646,365 | 3/1987 | Suprise et al. | 2/51 X |
| 4,649,572 | 3/1987 | Roessler | 2/49 R |
| 4,660,226 | 4/1987 | Quilling et al. | 2/49 R |
| 4,706,303 | 11/1987 | Van Gompel et al. | 2/49 R |

FOREIGN PATENT DOCUMENTS

| | | | |
|---|---|---|---|
| 715557 | 9/1954 | United Kingdom | 2/49 R |
| 2015867 | 9/1979 | United Kingdom | 2/49 R |

*Primary Examiner*—Louis K. Rimrodt
*Assistant Examiner*—J. L. Olds
*Attorney, Agent, or Firm*—M. M. Grill; N. Blumenkopf

[57] ABSTRACT

A disposable bib having a collection pocket, which is maintained in an opened position. The bib includes a base sheet of fluid impervious material and a top sheet of non-woven hydrophobic material. A pocket formed of the same material is formed by securing a section to the rear surface of the base sheet along at least the side edges with the section being secured to the base sheet along a location extending from the side edges of the sheet to a line at least three eighths of an inch inwardly thereof.

4 Claims, 2 Drawing Sheets

FIG. 1
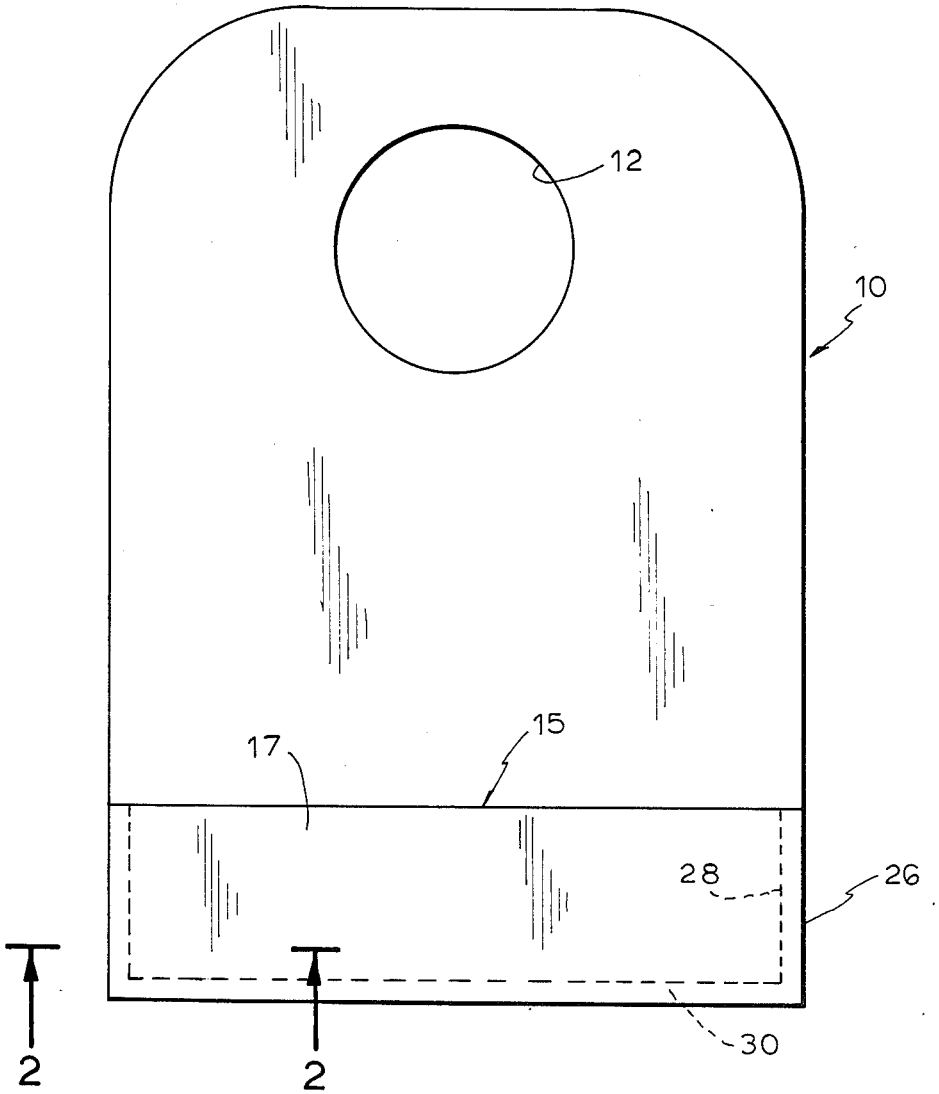
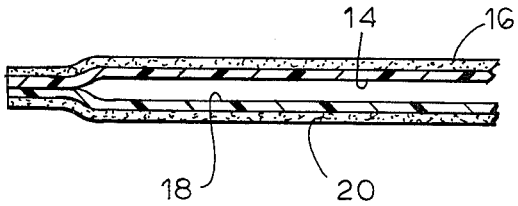
FIG. 2

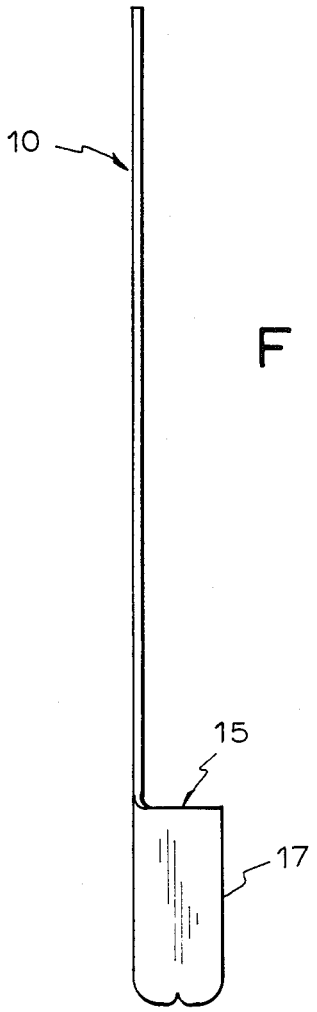
FIG. 4
FIG. 3
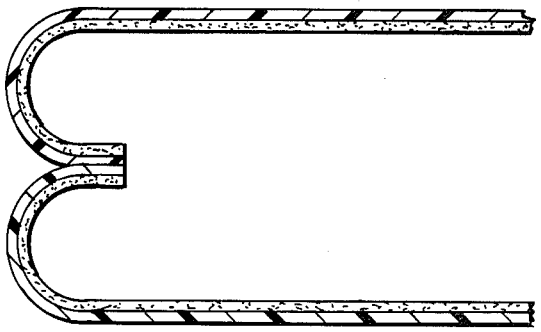

REUSABLE BIB HAVING MATERIAL-RECEIVING POCKET

BACKGROUND OF THE INVENTION

1. Field of the Invention

This invention relates to a bib and, more particularly, to a bib having a normally open pocket.

2. Description of the Prior Art

In the past, bibs, whether disposable or reusable, having been provided with pockets for catching crumbs, other food particles and even spilled liquids. These pockets would normally close on themselves so that the pocket opening would be too small to be effective. In order to assure an open pocket, various means have been employed to hold the pocket open. These would include additional spacers, springs, partitions or drapes to accomplish this purpose. Such arrangements for maintaining the pockets open may be found in U.S. Pat. Nos. 3,995,321, 4,261,057, 4,441,212, 4,445,231, 4,495,658 and 4,523,333. In addition, various means for suspending weights from hooks placed over the lip of the pocket have bee used. All of the foregoing arrangements for holding the pocket open have the disadvantage of being costly to manufacture and of being rather cumbersome.

SUMMARY OF THE INVENTION

The present invention contemplates the provision of a normally open pocket in a disposable or reusable bib which is held in its open position by the unique construction employed. To this end, the pocket is formed from a section of material secured to the bib along a location extending from the side edges of the bib to lines, which are at least three eighths of an inch inwardly of the edges so that, upon turning of the pocket inside out, it will remain in a widely open position. In the disposable bib according to the present invention the base sheet of fluid impervious material has a hydrophobic top sheet thereon and the pocket forming section is formed of the same material as the bib and may, in fact, be an integral extension thereof.

BRIEF DESCRIPTION OF THE DRAWINGS

FIG. 1 is a plan view of a bib constructed in accordance with the concepts of the present invention;

FIG. 2 is a sectional detail view, taken along the plane of line 2—2 in FIG. 1;

FIG. 3 is a sectional view of the bib shown with the pocket in the opened position; and, FIG. 4 is a side elevational view of a bib showing the pocket in its opened position.

DETAILED DESCRIPTION OF THE INVENTION

With continuing reference to the accompanying drawing, wherein like reference numerals designate similar parts throughout the various views, reference numeral 10 generally designates a bib constructed in accordance with the present invention.

The bib 10 is provided with an opening therethrough for positioning the bib over the head of the user. The bib is especially adapted for infants and young children, but may be used for older people requiring such bibs because of age, sickness or other infirmity.

The bib is constructed of a base or backing sheet 14, preferably of a fluid impervious sheet material, such as polyethylene film or polypropylene film. A top or outer sheet 16 is bonded to the base sheet 14. The top sheet 16 is formed of a hydrophobic non-woven spun-bonded material, which may be made from fibers of polyethylene or polypropylene or, most preferably, from a heat and spun-bonded non-woven material formed from nylon fibers. This material functions to provide for better pocket opening maintenance, provides more body to the bib and is essentially tear resistant.

The pocket 15 of the bib 10 is formed from a section 17 formed of the same material as the bib 10. The section 17 is provided with a base sheet 18 of a liquid impervious material of polyethylene or polypropylene film and the top sheet 20 is formed of a non-woven hydrophobic material, most preferably from the heat spun-bonded non-woven nylon fiber material. The pocket can, if desired, be formed from an extension of the bib or the section 17 may be separately provided.

The section 17 has its base sheet 18 facing the base sheet 14 of the bib 10. The section is bonded to the bib along a location extending the full length of the section and from the side edge 26 of the bib to a line 28 spaced inwardly from the side edge 26 at least three eighths of an inch.

The section may be secured at the bottom of the bib as by bonding at 30 if the section 17 is not an extention of the bib 10.

The bonding may be accomplished by adhesives, heat sealing or sonic welding and is desirably accomplished by using an adhesive which, preferably, is relatively stiff after setting so that the location where the pocket section 17 and bib 10 are secured will cause the pocket to remain in a wide open position.

The bib, constructed as heretofore recited, will be packaged in the pocket in closed position. The, when it is desired to use the bib, the pocket will be turned inside out and will retain the open position due to the position and manner of attachment of the pocket to the bib.

After use, the pocket is again turned inside out and, it is to be noted, that any crumbs remaining may be easily removed using a damp cloth or under a faucet. The use of the non-woven heat and spun-bonded nylon permits for many uses and easy cleaning without tearing or breaking before disposal is necessary. However, in the event that the bib is used when travelling or in a restaurant, it may be easily disposed of especially in view of its lost cost.

The bib may be made of cloth material from any type of textile and the pockets sewn, if desired, and may be easily laundered and reused.

What is claimed is:

1. A disposable bib comprising a base sheet of fluid impervious material, a non-woven hydrophobic top sheet bonded to said base sheet to form a composite sheet, said composite sheet having an opening therethrough for receiving a head of a user therethrough, a composite section and means securing said composite section to said composite sheet on the opposite sides thereof, said means extending at least three-eighths of an inch inwardly of the edges of said composite sheet, a layer of adhesive of relatively stiff construction when dried so that, when the pocket formed by said section and said composite sheet is turned inside out, said pocket remains widely open.

2. A disposable bib according to claim 1, wherein said section is integral with said composite sheet.

3. A disposable bib according to claim 1, wherein said means secured the bottom edge of said section to said composite sheet along a space at least three-eighths of an inch from the bottom edge of both said section and said composite sheet.

4. A disposable bib according to claim 3, wherein said non-woven hydrophobic material is a spun-bonded nylon.

* * * * *